US006637186B1

(12) United States Patent
Van Duyn

(10) Patent No.: US 6,637,186 B1
(45) Date of Patent: Oct. 28, 2003

(54) FAN CASE LINER

(75) Inventor: Keven G. Van Duyn, Bloomfield, CT (US)

(73) Assignee: United Technologies Corporation, Hartford, CT (US)

( * ) Notice: Subject to any disclaimer, the term of this patent is extended or adjusted under 35 U.S.C. 154(b) by 492 days.

(21) Appl. No.: 09/507,799

(22) Filed: Feb. 22, 2000

Related U.S. Application Data

(63) Continuation-in-part of application No. 09/967,519, filed on Nov. 11, 1997, now abandoned, and a continuation-in-part of application No. 09/220,544, filed on Dec. 23, 1998, now abandoned.

(51) Int. Cl.[7] ..... F02K 3/04
(52) U.S. Cl. ..... 60/223; 60/226.1; 415/9
(58) Field of Search ..... 60/226.1, 223; 415/9

(56) References Cited

U.S. PATENT DOCUMENTS 5,163,809 A * 11/1992 Akgun et al. ..... 415/9
5,403,148 A * 4/1995 Forrester ..... 415/9
5,447,411 A * 9/1995 Curley et al. ..... 415/9
5,456,576 A * 10/1995 Lyon ..... 415/173.3
5,823,739 A 10/1998 Van Duyn
6,113,347 A * 9/2000 Forrester ..... 415/9

FOREIGN PATENT DOCUMENTS

DE 37 12 829 A 11/1988

* cited by examiner

*Primary Examiner*—Ted Kim
(74) *Attorney, Agent, or Firm*—McCormick, Paulding & Huber LLP

(57) ABSTRACT

A fan containment case assembly 30 of a gas turbine engine 10 includes a hardened fan case liner 42 disposed therein. In the event of a fan blade loss condition, the hardened fan case liner allows for circumferential movement of the fan blade tips 38 around the fan case 48. Thus, the liner reduces the destructive cutting away of the fan case, minimizing damage to the fan case and decreasing torque loading of the fan case from rotor deflections. Alternate embodiments of the fan case liner are described.

9 Claims, 5 Drawing Sheets

FAN CASE LINER

This is a Continuation-In-Part of Ser. No. 09/967,519 filed Nov. 11, 1997, now abandoned, and a Continuation-In-Part of Ser. No. 09/220,544 filed Dec. 23, 1998, now abandoned.

TECHNICAL FIELD

The present invention relates to gas turbine engines, and more particularly, to a hardened liner disposed in the fan case of the engine to minimize damage in the event of a fan blade loss.

BACKGROUND ART

A gas turbine engine, such as a turbofan engine for an aircraft, includes a fan section, a compression section, a combustion section, and a turbine section. An axis of the engine is centrally disposed within the engine, and extends longitudinally through these sections. A primary flow path for working medium gases extends axially through the engine. A secondary flow path for working medium gases extends parallel to and radially outward of the primary flow path.

During operation, the fan draws air into the engine. The fan raises the pressure of the air drawn along the secondary flow path, thus producing useful thrust. The air drawn along the primary flow path into the compressor section is compressed. The compressed air is channeled to the combustor section, where fuel is added to the compressed air, and the air-fuel mixture is burned. The products of combustion are discharged to the turbine section. The turbine section extracts work from these products to power the fan and compressor. Any energy from the products of combustion not needed to drive the fan and compressor contributes to useful thrust.

The fan section includes a rotor assembly and a stator assembly. The rotor assembly of the fan includes a rotor disk and a plurality of outwardly extending rotor blades. Each rotor blade includes an airfoil portion, a root portion, and a tip portion. The airfoil portion extends through the flow path and interacts with the working medium gases to transfer energy between the rotor blade and working medium gases. The stator assembly includes a fan containment case assembly, which circumscribes the rotor assembly in close proximity to the tips of the rotor blades. The fan containment case assembly includes a fan case which provides a support structure, a plurality of fabric wraps disposed radially outwardly of the fan case, a plurality of circumferentially adjacent acoustic panels and a plurality of circumferentially adjacent rub strips disposed radially inwardly of the fan case. Conventional fan cases are typically a solid metal casing which forms a rigid structure to support the fabric wraps. The plurality of rub strips are formed from a relatively compliant material. In the event that the tip of a fan blade makes contact with the rub strips, the compliance of the rub strips minimizes the risks of damage to the fan blade.

It is desirable to a have reduced clearance between the fan blade tips and the fan case in turbine engines. There are two specific clearances between the fan blade tips and the fan containment case assembly which are of importance. The first one is characterized as a performance clearance and is defined as the clearance between the blade tips and the soft rub strip in the inner surface of the fan case. The second clearance is characterized as an effective structural clearance and is defined as the clearance between the blade tips and a hard metallic surface in the fan case. The present invention is concerned with this structural clearance, as opposed to the performance clearance.

The structural clearance between the hard surface of the fan case and the fan blade tips affects the dynamic response of the engine during severe rotor imbalance, particularly after a fan blade has failed and been released from the rotor assembly. A fan blade loss can result from either an impact with foreign objects or other structural reasons. The detached fan blade is thrown outward and passes through the fan case but is typically caught by the cloth wraps in the containment assembly. Blade loss produces an imbalance in the rotor and causes the rotor to move radially outward. The fan case then provides, in effect, a bearing surface to support the unbalanced array of fan blades. In this situation, the inner surface of the case acts as a bearing surface that engages the tips of the fan blades to support the rotor. The greater the initial radial separation between the fan blades and the inner surface of the case, the greater the amount of radial movement of the rotor that occurs before the case provides any bearing support. Movement of the rotor away from its longitudinal axis may also lead to additional damage to the rotor assembly. Minimizing the amount of radial movement minimizes the likelihood of further damage occurring. This decreased fan tip-to-case clearance reduces the imbalance sensitivity of the engine as the engine structure becomes "stiffer". However, due to their proximity to the fan case, the blades during a fan blade loss condition rapidly machine away the fan case because the blades are of usually a harder material than the fan case.

The fan blades with a tighter tip-to-case clearance, lean against the fan case with a much higher normal force to the fan case surface, thus creating a better structural load path. As a result, the engine's overall sensitivity to the imbalance loads is reduced. On the other hand, the fan rotor must still turn. The blades with their increased normal force and harder material literally machine away the fan case and, more importantly, create very high drag forces on the perimeter of the fan case. This machining away of the fan case aggravates the high torque loads seen in every engine during a fan blade loss event. The high torque puts tremendous loads on the engine mounts and case structure. Thus, in order to reduce the sensitivity of the engine to rotating imbalances, a very high torque load results. The advantages of reducing the engine's dynamic sensitivity to rotating imbalances are then lost to the generation of aggravated torque loads.

Thus, the challenge for modern gas turbine engines, during fan blade loss events, is the limiting of the rotor shaft deflection while minimizing the torque loading of the fan case from the rotor shaft kinetics.

DISCLOSURE OF THE INVENTION

According to the present invention, a fan case in a gas turbine engine includes a liner of hardened material attached thereto wherein during a fan blade loss condition, the blade tips skid on the hardened liner and reduce the destructive cutting away of the fan case. This liner of hardened material maintains the reduced fan-to-case clearances required to reduce the imbalance sensitivity of the gas turbine engine. Further, the sheet provides a skid-plate function which eliminates the generation of additional high torque loads due to the higher normal forces exerted by the fan blade tips while maintaining tight fan-to-case clearances. Further, the fan case structure of the present invention limits the deflection of the rotor shaft during a fan blade loss event. In one embodiment of the invention, the liner of hardened material comprises of shingles.

This invention is in part predicated on the recognition that by constraining the interaction of fan blade tips and the fan case to a predetermined radial zone in which is disposed hardened structure, there is a decrease of the loads transmitted to the interfaces of the engine by approximately the same percentage of the loads transmitted to the interfaces of the aircraft, and will allow an additional factor of safety during an abnormal imbalance condition of the rotor assembly.

According to one aspect of the present invention, a fan case in a gas turbine engine has a radial zone of interaction bounded outwardly by hard metallic surface of the fan case, the zone being a clearance which is less than one hundredth of the fan case diameter measured from the blade tips in a non-operative, zero speed engine condition with the rotor centered, a hardened structure disposed in the zone, such that during a high rotor imbalance condition, the blade tips skid on the hardened structure and reduce the destructive cutting away of the fan case, and reduce torque and imbalance loads transmitted to the interface of the engine and the aircraft.

In accordance with one particular embodiment of the invention, the optimal radial zone of clearance is defined as a constant approximately five-thousandths (0.005) of the fan case diameter.

In accordance with one particular embodiment of the invention, the lower limit of the radial zone of clearance is defined as a constant approximately two and one half thousandths (0.0025) of the fan case diameter, below which fan blades would destroy themselves due to high interaction loads between the fan blades and the fan case.

In accordance with another embodiment of the invention, the structural clearance lies in a range of 0.20 inches to 1.25 inches for corresponding jet engine fan case diameters which lie in a range of 20 inches to 120 inches.

The hardened structure or material is a liner which provides a skid-surface for the blades to circumferentially glide on and thus minimizes torque loading of the fan case. Further, the fan case structure of the present invention limits the deflection of the rotor shaft during a fan blade loss event. In one embodiment of the invention, the liner of the present invention comprises shingles of hardened material.

A primary advantage of the present invention is the minimization of damage to the fan case thus, resulting in a durable fan case in the event of a fan blade loss. The hardened fan case liner of the present invention reduces the destructive cutting away of the fan case by the fan blades. A further advantage is the maintenance of a minimum fan tip-to-case clearance which reduces the imbalance sensitivity of the engine. A further advantage of the fan case of the present invention is its ability to provide an appropriate restraining structure to the deflection of the rotor shaft during a fan blade loss event. In addition, the hardened liner reduces frictional forces and therefore, the torque transmitted from the rotor to the engine cases. Another advantage is the ease and cost of manufacturing and incorporating into the fan case the liner of the present invention. The simplicity of the structure of the liner and the use of economic materials, allows for cost effective manufacturing processes. Further, fan cases of the prior art can be retrofitted to include the present invention in a cost effective manner.

The foregoing and other objects, features and advantages of the present invention will become more apparent in the following detailed description of the best mode for carrying out the invention and from the accompanying drawings which illustrate an embodiment of the invention.

BEST MODE FOR CARRYING OUT THE INVENTION

Figure 1:
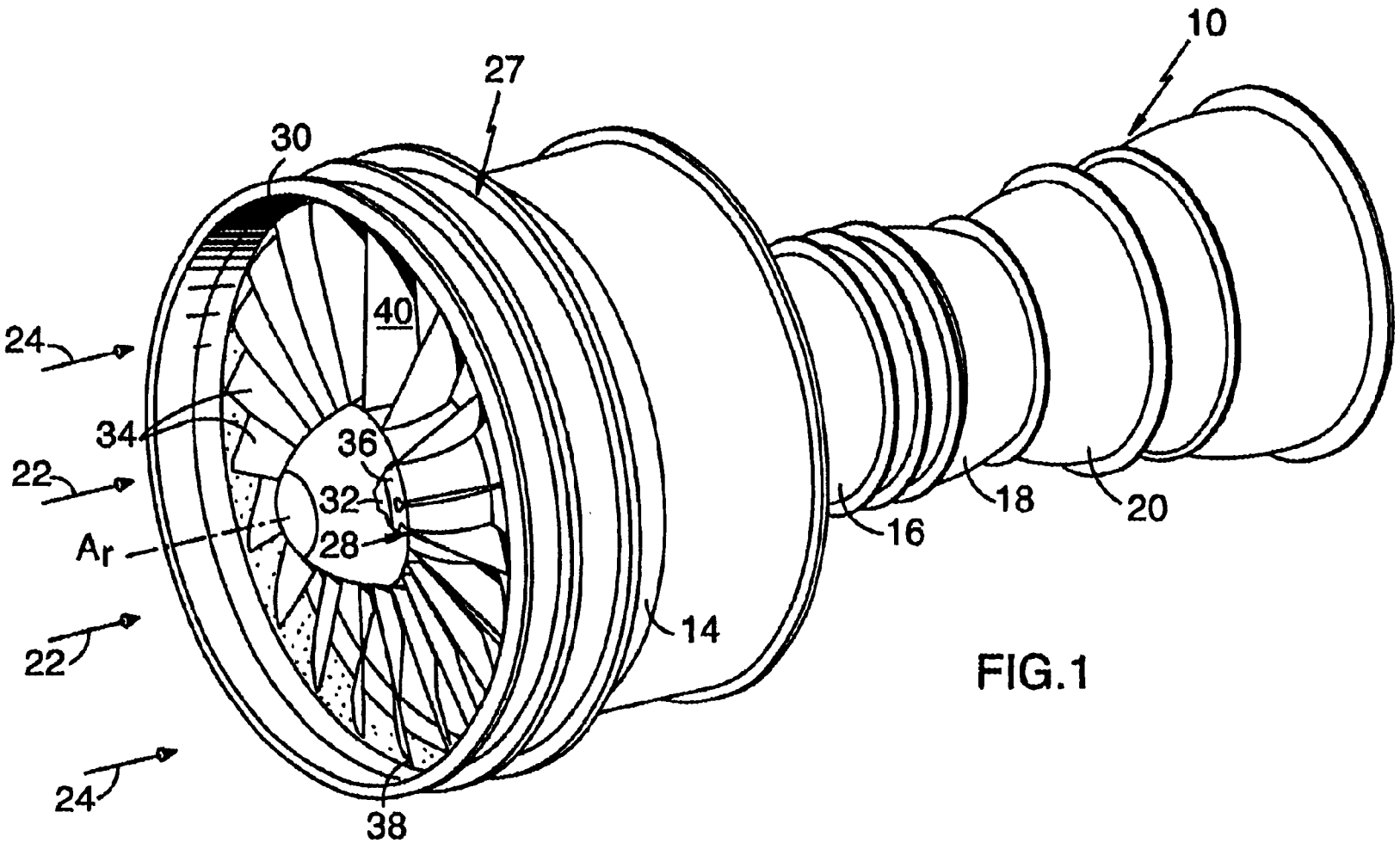
FIG. 1 is a perspective view of an axial flow, turbofan gas turbine engine.
Figure 2:
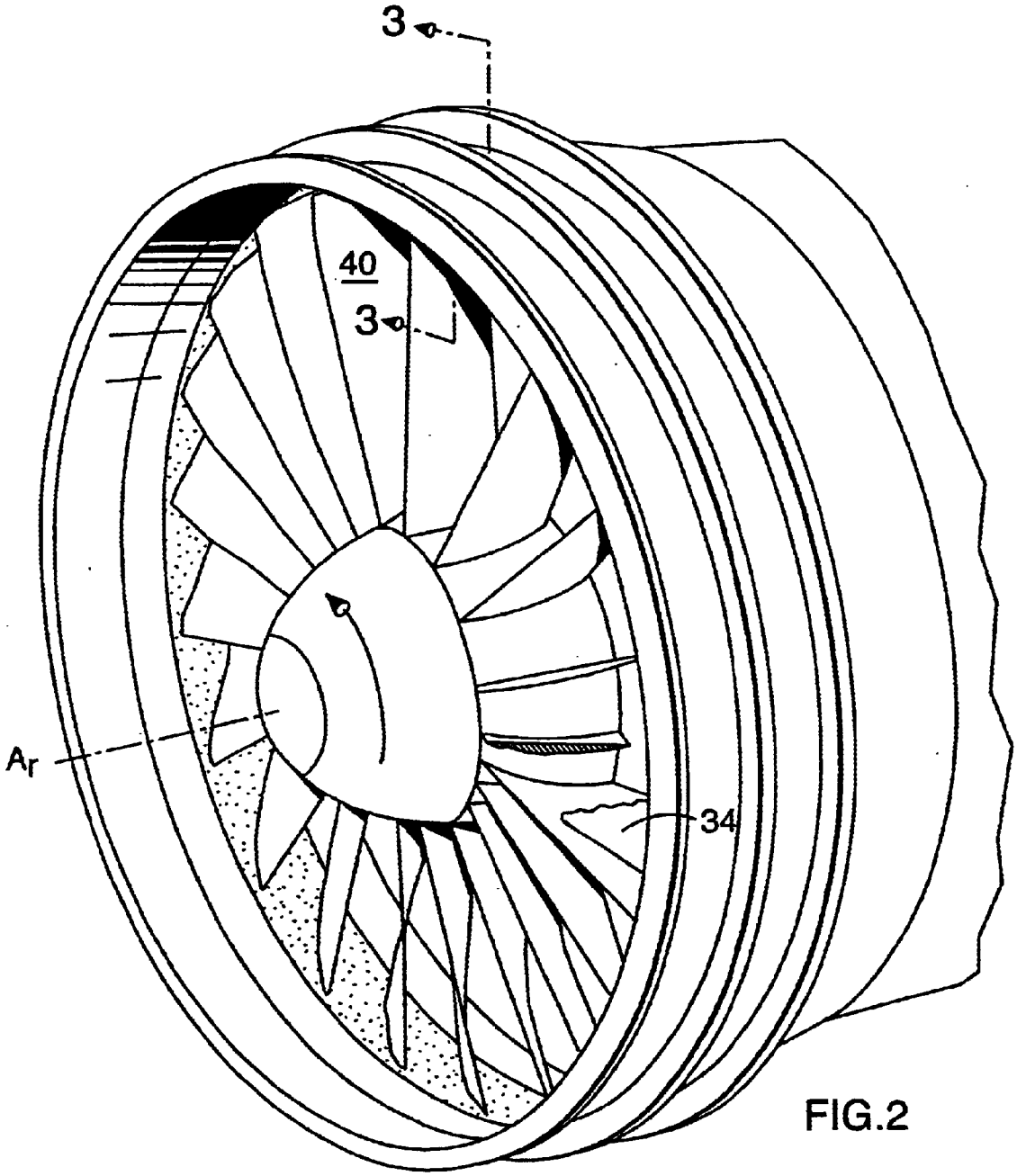
FIG. 2 is a perspective view of a rotor assembly of the gas turbine engine of FIG. 1 showing a released fan blade.

Referring to FIG. 1, an axial flow, turbofan gas turbine engine 10 comprises a fan section 14, a compressor section 16, a combustor section 18 and a turbine section 20. An axis of the engine $A_r$ is centrally disposed within the engine and extends longitudinally through these sections. A primary flow path 22 for working medium gases extends longitudinally along the axis $A_r$. The secondary flow path 24 for working medium gases extends parallel to and radially outward of the primary flow path 22.

The fan section 14 includes a stator assembly 27 and a rotor assembly 28. The stator assembly has a fan containment case assembly 30 which forms the outer wall of the secondary flow path 24. The rotor assembly 28 includes a rotor disk 32 and a plurality of rotor blades 34. Each rotor blade 34 extends outwardly from the rotor disk 32 across the working medium flow paths 22 and 24 into proximity with the fan containment case assembly 30. Each rotor blade 34 has a root portion 36, an opposed tip 38, and a midspan portion 40 extending therebetween. The fan containment case assembly 30 circumscribes the rotor assembly 28 in close proximity to the tips 38 of the rotor blades 34.

Figure 3:
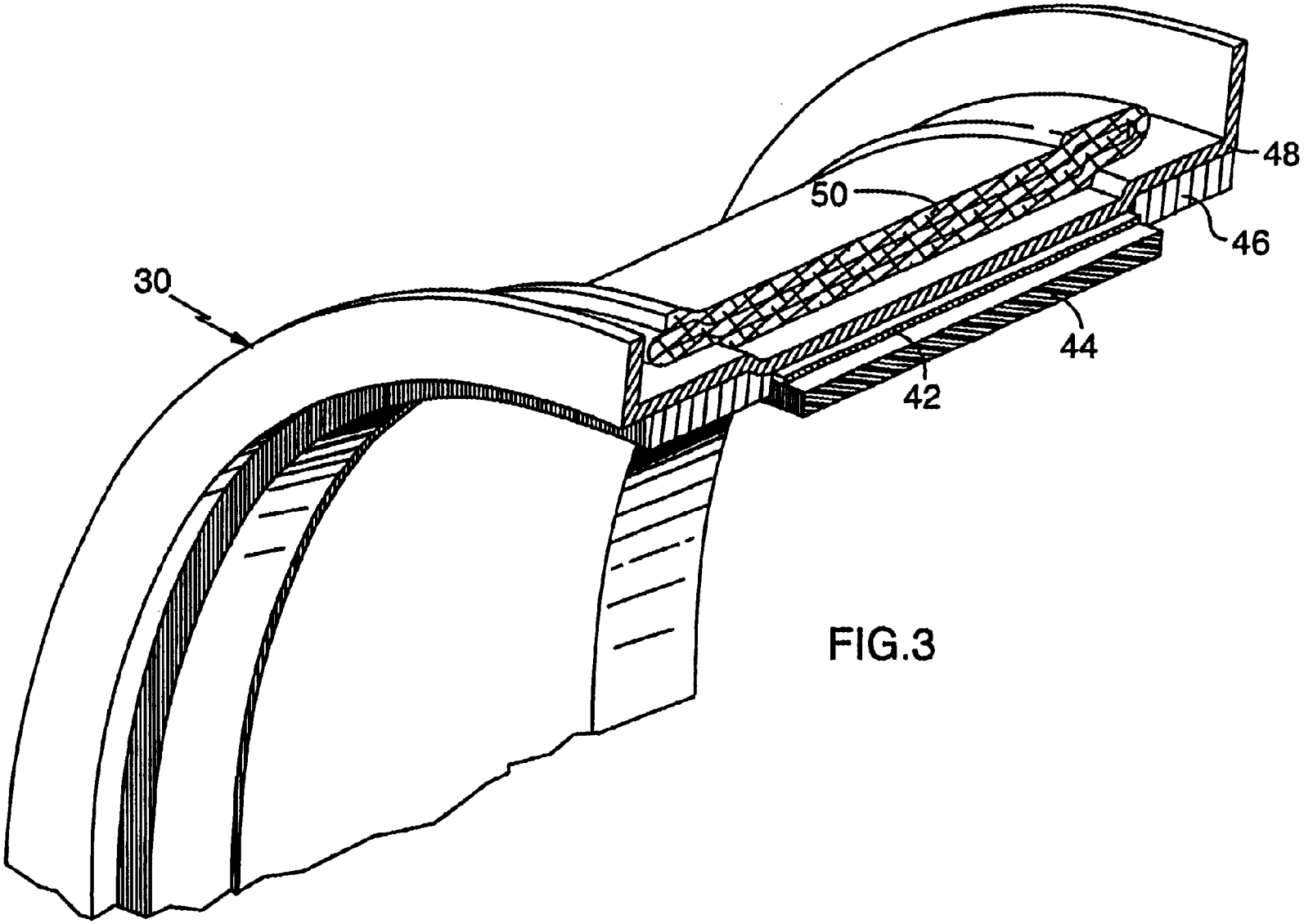
FIG. 3 is a cross-sectional schematic representation of a fan containment case assembly including the fan case of the present invention taken along the lines 3—3 of FIG. 2.

Referring to FIG. 3, the containment case assembly 30 includes a liner 42, a plurality of circumferentially adjacent rub strips 44 and a plurality of circumferentially adjacent acoustic panels 46 disposed radially inwardly of a support structure or a fan case 48. A plurality of fabric wraps 50 are disposed radially outwardly of the fan case. The fan case is typically a solid metal casing which forms a rigid structure to support the fabric wraps. The term "fabric" 50 includes, but is not limited to, tape, woven material or the like, and restrains a fan blade in the event of a fan blade loss. The rub strips 44 are formed from a relatively compliant material. The rub strips 44 permit the fan blades 34 to be in close proximity to the fan case to minimize the amount of air that flows around the fan blades, thus reducing fluid flow leakage around the fan blades to improve fan performance. In the event that the tip 38 of a fan blade 34 makes contact with the rub strips 44, the compliance of the rub strips minimizes the risk of damage to the fan blade 34. The fan case liner 42, is made from hardened material such as from alloys of stainless steel or nickel. The nickel alloy Inconel 718, or stainless steel alloys, such as AISI 321 or AISI 347, are examples of alloys that can be used to manufacture the liner. The liner is thus manufactured from material that is harder than the fan blade tip material which is typically titanium. For ease of installation, the liner could be manufactured as arced segments which can then be bonded to the fan case.

Figure 4:
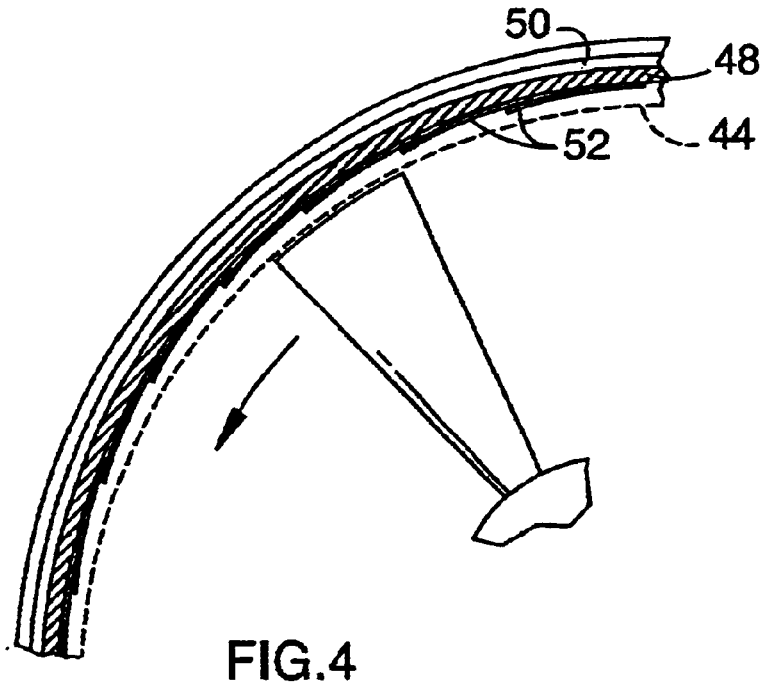
FIG. 4 is a schematic representation of a fan case liner of the present invention under operating conditions.
Figure 5:
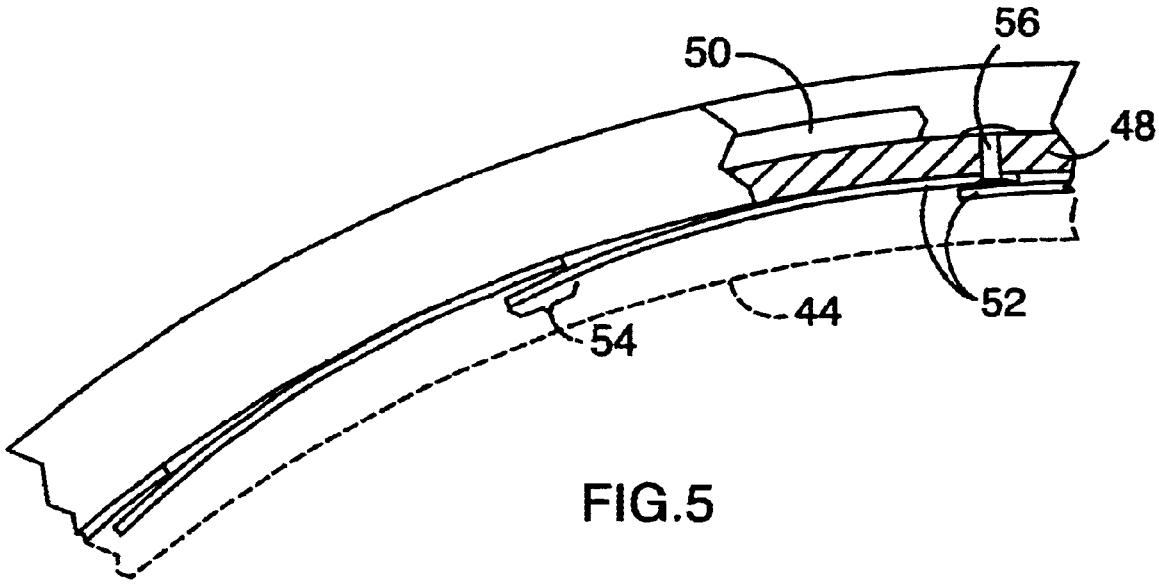
FIG. 5 is a schematic representation of an alternate embodiment of the fan case liner of the present invention.

Referring to FIG. 4, a segmented fan case liner of the present invention is disposed radially outwardly of the rub strip 44 in the fan containment case assembly 30. Each segment 52 or shingle is offset from its adjacent shingle, yet there is an overlap region 54, shown clearly in FIG. 5, between adjacent shingles. As shown in FIG. 5, the fan case liner 42 is attached to the fan case 48 by either rivets 56, or adhesives as shown in FIG. 4. The rivets 56 are located in the overlap region 54 between adjacent shingles.

Figure 6:
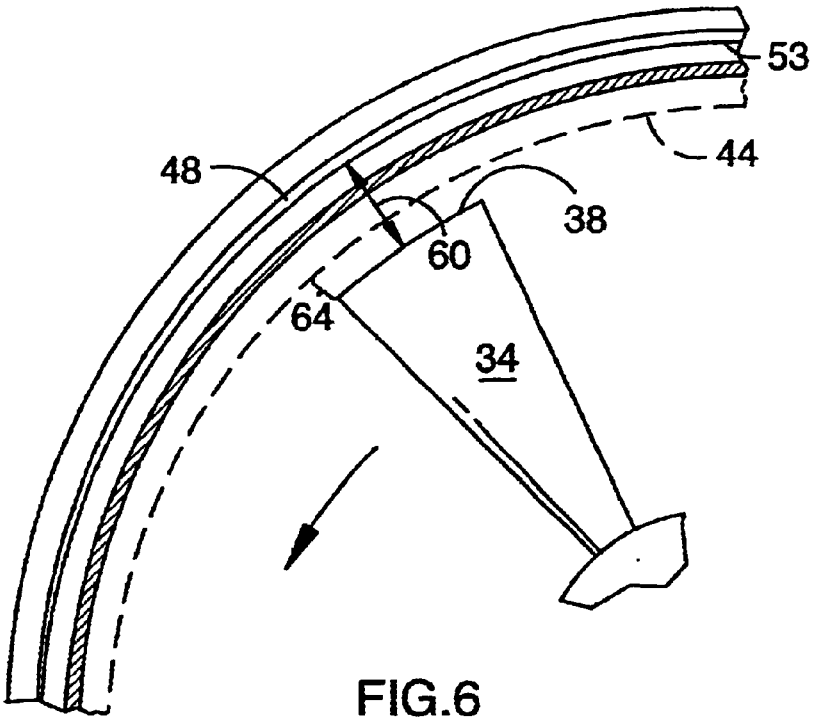
FIG. 6 is a schematic representation of the radial zone of interaction between the fan blade tips and the hardened inner surface of the fan case of the present invention.

Referring to FIG. 6, a radial zone of interaction 60 is a clearance bounded inwardly by the blade tips 38 in a non-operative, zero speed engine condition with the rotor centered about the engine centerline and the blades in their engaged position with the rotor. The radial zone of interaction 60 is bounded outwardly by the hardened inner surface 53 of the fan case 48. The radial zone of interaction is referred to hereinafter as the structural clearance. The hardened liner 42 is disposed in the radial zone of interaction. The structural clearance 60 is less than one hundredth of the fan case diameter. The optimal structural clearance measured from the fan blade tips is about five thousandths (0.005) of the fan case diameter. The lower limit of the radial zone of clearance is defined as a constant approximately two and one half thousandths (0.0025) of the fan case diameter, below which fan blades would destroy themselves. The fan blade tips may be compromised by the bending or buckling of the tips if the interaction loads between the fan blade tips and the fan case are increased by reducing the structural clearance to a value of about zero.

Another clearance, referred to as the performance clearance 64 is defined as the clearance between the fan blade tips and the soft rubstrip 44 disposed in the inner surface of the fan case 48. The performance clearance is measured for a fan blade during a steady state cruise condition with the rotor in an undisturbed position, i.e. with the axis of the fan rotor being concentric with the engine centerline. The performance clearance is positioned within the structural clearance and is typically less than the optimal structural clearance. The soft rubstrip provides sealing during engine maneuver conditions. The rubstrip additionally provides for a level of mechanical isolation from vibrations between the fan blade tips and the fan case. Further, another reason why the structural clearance 60 cannot be reduced to a value of zero is the need to dispose some soft rubstrip material between the fan blade tips and the hard fan case.

Figure 7:
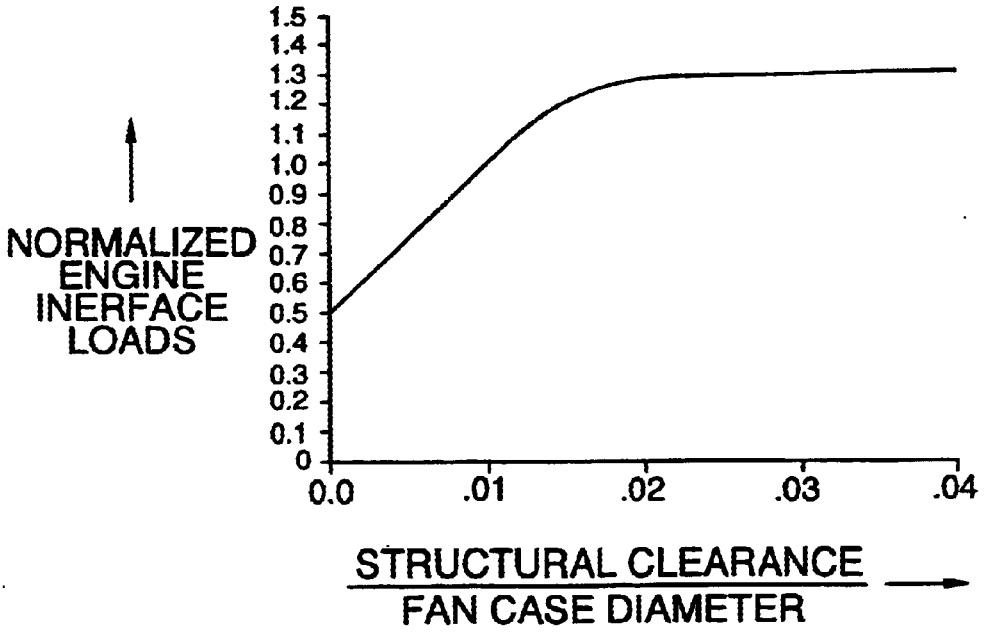
FIG. 7 is a graphical representation of normalized engine interface loads versus the ratio of the structural clearance to the fan case diameter.

Referring to FIG. 7, the normalized engine interface loads are plotted versus a ratio of the structural clearance to the fan case diameter for a typical modern gas turbine engine. The normalization of the engine interface loads is based on a typical structural clearance of one inch (1"). The curve shown in FIG. 7 is representative of loads at different engine to aircraft interfaces and is dependent on several factors some of which are the weight of the fan case and related hardware attached to the fan case such as a nacelle, the fan case stiffness relative to the engine, the ratio of the weight of the combination of the fan and blades to the weight of the fan case, and the dynamics of the rotor such as the frequency of the rotor.

The interface loads cannot be reduced beyond the normalized value of about 0.5 due to the structural characteristics of the fan case, i.e., a heavier fan case would be required to increase the transmission of loads to the fan case thereby reducing rotor deflections. As the structural clearance is reduced, the fan case interacts more closely with the fan blade tips and as such the fan case constrains the deflection of the imbalanced rotor by inertial resistance. As a result, there is a decrease in the amplitude of the rotor deflections which results in the decrease of the forces or loads transmitted through the bearing support structure. Thus, the kinetic energy associated with the imbalance of the rotor is transmitted through the fan blade tips into the fan case and is largely dissipated by the translational (radial) movement of the fan case. A portion of the kinetic energy associated with the imbalance of the rotor is dissipated by the movement of the fan blades relative to the fan case. The associated heat generated due to the frictional forces between the fan blade tips and the fan case is dissipated in the materials of the fan case and blade structure.

During operation of the gas turbine engine, the working medium gases are compressed in the fan section 14 and the compressor section 16. The gases are burned with fuel in the combustion section 18 to add energy to the gases. The hot, high pressure gases are expanded through the turbine section 20 to produce thrust in useful work. The work done by expanding gases drives rotor assemblies in the engine, such as the rotor assembly 28 extending to the fan section 14 across the axis of rotation A.

In the event of a fan blade loss during engine operation, the detached blade is thrown radially outwardly. It typically will pass through the fan case 48 and will be caught by the fabric wraps 50 in the fan containment case assembly 30.

The blade loss produces an imbalance in the rotor and causes the rotor to move radially outward in close proximity to the fan case. The separation between the fan blades and the inner surface of the fan case is minimized in modem engines to decrease the radial movement of the rotor assembly. The fan blades with a tighter tip-to-case clearance, lean against the fan case with a high normal force. The fan blade tips, with their increased normal force, machine away the compliant rub strip 44 in the innermost surface of the fan containment assembly. The thin, fan case liner, made from hardened materials such as steel or nickel, provides a skid surface for the relatively softer blades. The fan blades move circumferentially along on the skid surface of the liner. The machining away of the fan case is eliminated or reduced. The embedding of the blades in the fan case is eliminated or reduced; and as a result, the unwanted torque loading of the case is reduced. Without the hardened liner, the fan blades would continue to cut away and firmly embed in the fan case. The present invention, thus provides for a system that allows for reduced fan tip-to-case clearances which reduces the imbalance sensitivity of the engine and provides the skid-plate function which eliminates or reduces the generation of additional machining torque as well as allows for limiting rotor deflection during a fan blade loss event.

As described hereinabove, the shingled embodiment, also provides a skid-surface for the fan blades to circumferentially rotate upon. However, by being segmented, the damage to the liner after a fan blade loss event is limited to the loss of one or more adjacent shingles. The remaining shingles continue to provide an effective skid-surface for the fan blades to glide on.

A primary advantage of the present invention fan case liner is the minimization of damage to the fan case thus, resulting in a durable fan case in the event of a fan blade loss. The liner reduces the destructive cutting away of the fan case by the fan blades. A further advantage of the skid-surface is the maintenance of a minimum fan tip-to-case clearance which reduces the imbalance sensitivity of the engine. A further advantage of the present invention fan case is its ability to provide an appropriate restraining structure to the deflection of the rotor shaft during a fan blade loss event. In addition, the liner reduces frictional forces, and as a result, reduces torque loads transmitted from the fan rotor to the case. Another advantage is the ease and cost of manufacturing and incorporating the hardened fan case liner of the present invention. The simplicity of the structure of the liner and the use of economical materials, allows for cost effective manufacturing processes. Further, current, prior art fan cases can be retrofitted to include the fan case liner in a cost effective manner. By incorporating the present invention liner, current engines limit damage to the fan containment case assembly and to the rotor shaft.

Although the invention has been shown and described with respect to detailed embodiments thereof, it should be understood by those skilled in the art that various changes in form and detail thereof may be made without departing from the spirit and the scope of the claimed invention.

What is claimed is:

1. A gas turbine engine disposed about a longitudinal axis, the gas turbine engine having a rotor and a stator, the rotor including a fan, the fan having a plurality of blades mounted thereon, the stator including a fan case disposed radially outward of the fan, wherein the improvement is characterized by:

a segmented hardened liner disposed in the fan case to circumscribe the fan blades for minimizing the damage to the fan case during a fan blade loss condition by allowing the fan blades to skid along the segmented liner and for precluding the embedding of the blades in the fan case to minimize unwanted torque loading of the fan case, with the hardened liner being harder that the fan blade tip material;

wherein by the segmented hardened liner includes a plurality of plate shingles circumferentially disposed in the fan case, each of the plurality of the shingles being offset from adjacent shingles and forming an overlap region between the adjacent shigles.

2. A gas turbine engine disposed about a longitudinal axis, the gas turbine engine having a rotor and a stator, the rotor including a fan, the fan having a plurality of blades mounted thereon, the stator including a fan case disposed radially outward of the fan, wherein the improvement is characterized by:

a hardened liner disposed in the fan case to circumscribe the fan blades; said liner having an interior surface for minimizing the damage to the fan case during a fan blade loss condition by allowing the fan blades to skid ablong the interior surface of the liner and for precluding the embedding of the blades in the fan case to minimize unwanted torgue loading of the fan case, with the hardened liner being harder than the fan blade tip material; and a radial zone of interaction bounded outwardly by the hardened liner, the zone being measured from the fan blade tips in a non-operative condition and fully engaged with the fan disk, wherein the rotor is centered about the engine, such that during a high rotor imbalance condition the fan blades skid along the interior surface of the hardened liner as opposed to embedding in the fan case thereby reducing torque and imbalance loads.

3. The gas turbine engine of claim 2, wherein the hardened liner is formed from a metal plate circumferentially disposed in the fan case.

4. A gas turbine engine having a centerline, a rotor having a centerline of rotation coincident with said engine centerline, the rotor including a fan, the fan having a disk, blades and tips at one end thereof, a stator including a fan case having a characteristic diameter, disposed radially outward of the fan, wherein the improvement is characterized by:

a hardened structure having an interior surface, disposed in the fan case; and a radial zone of interaction which extends for a distance less than one hundredth of the fan case diameter, said radial zone of interaction bounded outwardly by the hardened structure, the zone being measured from the fan blade tips in a non-operative condition and fully engaged with the fan disk, wherein said rotor is centered about the engine, such that during a high rotor imbalance condition the fan blades skid along the interior surface of the hardened structure as opposed to embedding in the fan case thereby reducing torque and imbalance loads.

5. The gas turbine engine of claim 4, wherein said radial zone of interaction has an optimal clearance value of about five thousandths (0.005) of the fan case diameter as measured from the fan blade tips in a non-operative condition.

6. The gas turbine engine of claim 4, wherein said radial zone of interaction has a minimal clearance value of about two and one half thousandths (0.0025) of the fan case diameter as measured from the fan blade tips in a non-operative condition below which said fan blades destroy themselves.

7. The gas turbine engine of claim 4, wherein the hardened structure is a thin, skid-plate circumferentially disposed in the fan case.

8. The gas turbine engine of claim 4, wherein the hardened structure is a segmented liner disposed in the fan case so as to circumscribe the fan blades.

9. The gas turbine engine of claim 8, wherein the segmented liner further includes thin, skid-plate shingles circumferentially disposed in the fan case, said shingles being offset from adjacent shingles and having an overlap region between said adjacent shingles.

* * * * *

UNITED STATES PATENT AND TRADEMARK OFFICE

CERTIFICATE OF CORRECTION

PATENT NO. : 6,637,186 B1
DATED : October 28, 2003
INVENTOR(S) : Keven G. Van Duyn It is certified that error appears in the above-identified patent and that said Letters Patent is hereby corrected as shown below:

Column 7,
Line 33, please change “that” to -- than --.
Line 39, please change “shigles” to -- shingles --.
Line 50, please change “ablong” to -- along --.
Line 52, please change “torgue” to -- torque --.

Signed and Sealed this

Third Day of February, 2004

JON W. DUDAS
*Acting Director of the United States Patent and Trademark Office*